United States Patent [19]

Marass et al.

[11] 4,174,831

[45] Nov. 20, 1979

[54] DEVICE FOR INSERTING A NEW STACK OF SHEETS IN FEEDING POSITION WITHOUT INTERRUPTION OF SHEET-FEEDING MECHANISM OPERATION

[75] Inventors: Josef Marass, Seehausen; Rudolf Liepert, Augsburg, both of Fed. Rep. of Germany

[73] Assignee: Georg Spiess GmbH, Gersthofen, Fed. Rep. of Germany

[21] Appl. No.: 823,671

[22] Filed: Aug. 11, 1977

[30] Foreign Application Priority Data

Aug. 18, 1976 [DE] Fed. Rep. of Germany ..... 2637086

[51] Int. Cl.[2] ..... B65H 1/26

[52] U.S. Cl. ..... 271/159; 271/171

[58] Field of Search ..... 271/159, 158, 157, 171, 271/218, 223, 224; 214/8.5 A; 414/118, 119

[56] References Cited

U.S. PATENT DOCUMENTS

| | | | |
|---|---|---|---|
| 3,477,324 | 11/1969 | Schwebel | 271/159 X |
| 3,951,401 | 4/1976 | Marass | 271/158 |

*Primary Examiner*—Bruce H. Stoner, Jr.

*Attorney, Agent, or Firm*—Frishauf, Holtz, Goodman & Woodward

[57] ABSTRACT

The rear cross rod that supports the carrier rods insertable in grooves in a stacking table for continuing the lifting of a residual stack while the table is lowered for loading a fresh stack without interrupting operations from the top of the residual stack, supports the cross rods from hanging collar brackets on its underside so that the rear cross rod has its body above the carrier rod and is adjustable along the length of the carrier rod and can function as an effective rear stack stop to stabilize the stack position. In one embodiment the rear cross rod is fixed in its position for a particular stack size by clamping sliding brackets on lateral rods that run from the respective ends of the front cross rods back to an extremity at which the rear chains of the hoist are connected. In another embodiment the rear cross rod is suspended directly by the rear hoist chains that run over pulleys which are adjusted horizontally to position the rear cross rod, while a scissors mount held on the rear support pillars of the frame of the sheet-feeding mechanism is provided that may be clamped in position to prevent rearward swinging of the rear cross rod once it has been moved into position. The pulley system in this case makes possible horizontal adjustment of the rear cross rod without change of the level at which it is suspended.

12 Claims, 5 Drawing Figures

DEVICE FOR INSERTING A NEW STACK OF SHEETS IN FEEDING POSITION WITHOUT INTERRUPTION OF SHEET-FEEDING MECHANISM OPERATION

This invention relates to a device in a continuously operable sheet-feeding mechanism for a printing press or the like, for replenishing a stack of sheets in position for sheet-feeding without interruption of the progress of the operation. Such devices are sometimes known as non-stop devices for a sheet-feeding mechanism.

The stacking table on which the stack of sheets is gradually raised, so that the sheet-feeding mechanism can operate continuously on the top of the stack, is mounted in a frame in which its hoist mechanism is rigged. The stacking table has a set of parallel grooves running in the direction of sheet-feeding and distributed over the surface of the table, into which a set of parallel carrier rods can be inserted from the rear (front and rear being defined in the direction of sheet-feeding) underneath the stack, so that when the stack is depleted, a second hoist can lift the carrier rods, usually operating on cross rods below the front and rear of the carrier rods, to continue the upward movement of the depleted stack while the stacking table is lowered by the first hoist to receive a fresh, full stack beneath the carrier rods, which are then withdrawn, lowered and reinserted in the grooves of the stacking table.

In the above described manner it is possible to provide for uninterrupted operation of the sheet-feeding mechanism even during the loading of a new stack of sheet material into position for use in the machine. Uninterrupted operation can be continued in this manner with repeated replenishment of the stack of sheet material from time to time.

In the known devices of this type, for example the one disclosed in German Pat. No. 1,076,150, the cross rods are arranged at a fixed distance from each other that corresponds essentially to the length of the carrier rods to be lifted by the cross rods. Consequently, regardless of the dimensions of the sheet material to be stacked on the carrier rods, the carrier rods are supported in the vicinity of their respective ends. As a result, there is evidently an unnecessarily great bending length for the carrier rods in many instances of their use and a correspondingly great amount of sag that is a disadvantage in operation. It is particularly disadvantageous that the rear edge of the stack is not supported and therefore shifts in accordance with the amount of carrier rod sag. This can go so far as to cause the depleted stack being carried on the carrier rods to slide or collapse to the rear, or in other cases to lean rearwards so that the forward edge of the stack diverges away from the front stops provided for the stack. The known devices, therefore, tend to a considerable extent to produce jamming of the feeding operation as the result of shifting or leaning of the feed stack. A further disadvantage of the known devices is that the depleted stack resting on the carrier rods has no rear stop. When the carrier rods are withdrawn, the friction that is present can easily produce a slipping or collapse of the stack portion above the carrier rods, which will likewise lead to jamming of the operation.

It is an object of the present invention to overcome the disadvantages of the known devices and to provide a simple and also reliable device that will not only make possible a reduction of the free bending length of the carrier rods to the stack dimension to be used, but also guard against an undesirable displacement of a stack resting on the carrier rods both during operation and during withdrawal of the carrier rods.

SUMMARY OF THE INVENTION

Briefly, the rear cross rod is made adjustable in the direction of sheet feeding and is given a configuration such that it can provide a rear stop for the stack. By such provision of the rear cross rod as a loose adjustable component it is possible to provide support for the cross rods in the region of the rear edge of the stack regardless of the dimensions of the sheet material that is stacked. Any sagging of the carrier rods that may still be present then does not affect the position of the stack, because the sag produces no tilt to the stack. Furthermore, for each particular case, the shortest possible free bending length of the carrier rods is utilized, so that any remaining sag can be readily limited to negligible amounts. This highly desirable adjustability can fortunately be combined conveniently in accordance with the invention, with the provision of a rear cross rod configuration that can function as a rear stop for the stack. The residual portion of an earlier load, resting on the carrier rods, can then be held exactly in position even during the withdrawal of the carrier rods. The features provided by the invention lead to a considerable reduction of the risk of jamming or interrupting the rhythm of the machinery and thereby produce an improvement in the efficiency of utilization of the machine. The invention is accordingly to be regarded mainly as an improvement making possible more economical operation of the entire machine to which the stack replenishing device of the sheet-feeding system is connected.

A particularly advantageous embodiment of the invention has a rear cross rod provided at or near its underside with holders for the carrier rods. In this case the body of the rear cross rod lies advantageously entirely above the carrier rods and itself serves as the rear stack stop. This results in most conveniently keeping down the number of individual components of the device. Furthermore, such construction avoids any interference with accessibility by an overly long stacking table.

It is particularly effective to provide the carrier rod holders extending below the rear cross rod in the form of collars encircling the carrier rods. In an embodiment of the invention that has been found particularly effective, the further improvement is provided of adjustably supporting the rear cross rod on two lateral rods at positions respectively corresponding to the stack dimension in the direction of sheet-feeding. In a further carrying forward of this concept the two lateral rods are mounted with their front ends on the front cross rod and their rear ends on a hoist, for example a hoist chain or cable. These features provide a particularly massive and therefore stable configuration of construction and are compatible with the use of an unmodified conventional carrier rod hoist system.

A further improvement of the embodiment above described lies in making the lateral rods removable, for example as demountable suspension members. In this way the greatest possible lateral accessibility of the apparatus is made possible even when the stack replenishing device is stopped.

Both of the lateral rods can advantageously be fitted with a holder for the rear cross rod that is guided on the lateral rod. These holders can conveniently and effectively have a fork-like head in which the rear cross rod can be seated. In this way it is possible to bring the rear cross rod conveniently and securely into the desired position in abutment with the rear edge of the stack. Furthermore, clamping means can advantageously be used for fixing these holders on the corresponding lateral rod, thus providing a simple adjustability on the one hand, and assuring undisturbed operation over long periods on the other hand.

In a particularly improved embodiment of the invention a hoist is connected to the ends of the rear cross rods, whatever its adjustment along the length of the carrier rods, and the fall of the hoist drops from pulleys the axles of which are shiftable in the direction of sheet-feeding in accordance with stack dimension in that direction. In embodiments of this type the lateral rods above referred to can be dispensed with and likewise the holders mounted thereon so that in any position of operation there is unhindered lateral accessibility. In order that adjustment of the rear cross rod may be made without altering the hoist adjustment for the level at which the rear cross rod is supported, each pulley of the hoist that is shifted, like the rear cross rod, proportionally with the stack dimension, has a mate which is shifted by only haft that much around which the fall of the hoist is reeved, so that as the rear cross rod and the pulleys are shifted there is no change in the level of support of the rear cross rod by the hoist.

Finally, in still another improved embodiment of the invention, the rear cross rod, which may be in the form of a beam having a considerable vertical cross-sectional dimension, is rearwardly supported against the machine's frame ("backed up") by means of adjustable cross braces of the scissors type, which can be clamped in position for the particular stack dimension. In this manner it is made sure that the rear cross rod that serves as a rear stop for the stack (or is provided with a stack stop) is backed up over its entire effective region against any yielding or deviation out of position.

The invention is further described by way of illustrative example with reference to the annexed drawing, in which.

Figure 1:
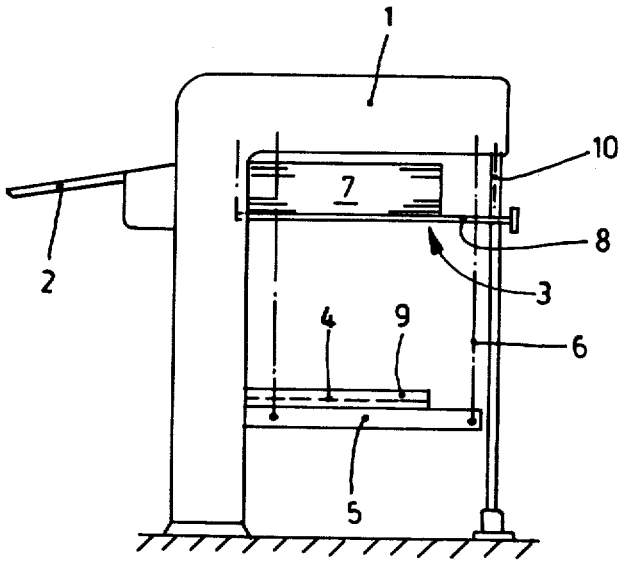
FIG. 1 is a diagrammatic side elevation view of the stack-replenishing device of a sheet-feeding mechanism.

Sheet-feeding mechanisms of the kind designated 1 in FIG. 1 are as a rule coupled by a feed chute 2 to a sheet processing machine, for example a printing press, not shown in FIG. 1 in order to simplify the illustration. Uninterrupted sheet-feeding operations are possible with the help of a so-called non-stop device, given the general designation 3, that allows a fresh stack of sheets to be brought in below while the residue of a stack previously loaded continues to be presented to the sheet-feeding device. During most of the operation the sheet stack to be fed into the machine is supported on a stacking table 4 that rests on carrying rails 5 which cooperate with a main hoist indicated in FIG. 1 by its lifting chain 6. If the stack has been used up to such an extent that there is only a small height of it left, about 50 cm, it is then taken over by the non-stop device 3.

In the condition of operation illustrated in FIG. 1, the residual stack still present has been picked up by the carrier rods 8 that during the previous normal operation had been inserted from the rear into corresponding grooves 9 of the stacking table 4 so as to place them in position underneath the stack then carried on the table. The grooves 9 and also the carrier rods 8 are distributed evenly over the entire width of the stack (the other horizontal dimension of the stack, which is in the plane of the drawing, is here referred to as its length).

While the carrier rods 8 are gradually lifted in step with the operation of the sheet-feeding device in order to enable the feeding and the machine being fed to carry on without disturbance, the carrier rails 5 can now be lowered in order to pick up a fresh stack. The carrier rods 8 during that operation rest on cross rods not shown in FIG. 1 which are operatively connected to a so-called non-stop hoist of which the hoisting chain or cable 10 is designated in the drawing.

Figure 2B:
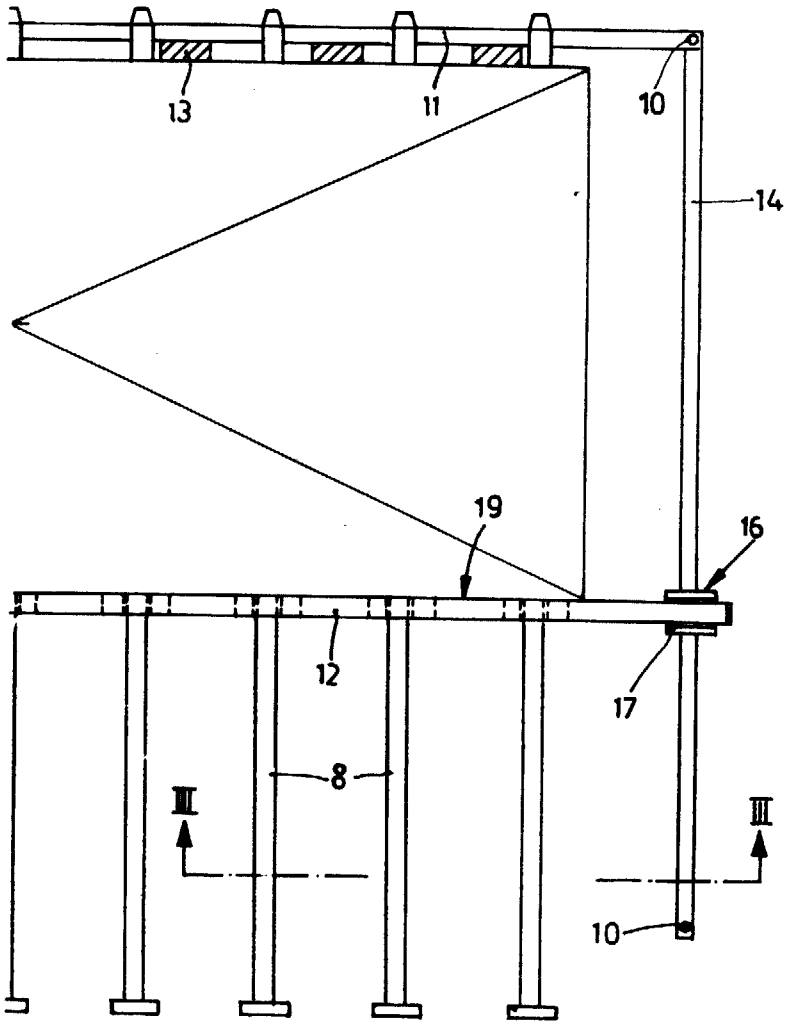
FIG. 2B is a top view of the portion not shown in FIG. 2A of the same embodiment and illustrates a different position of the rear cross-beam.
Figure 2A:
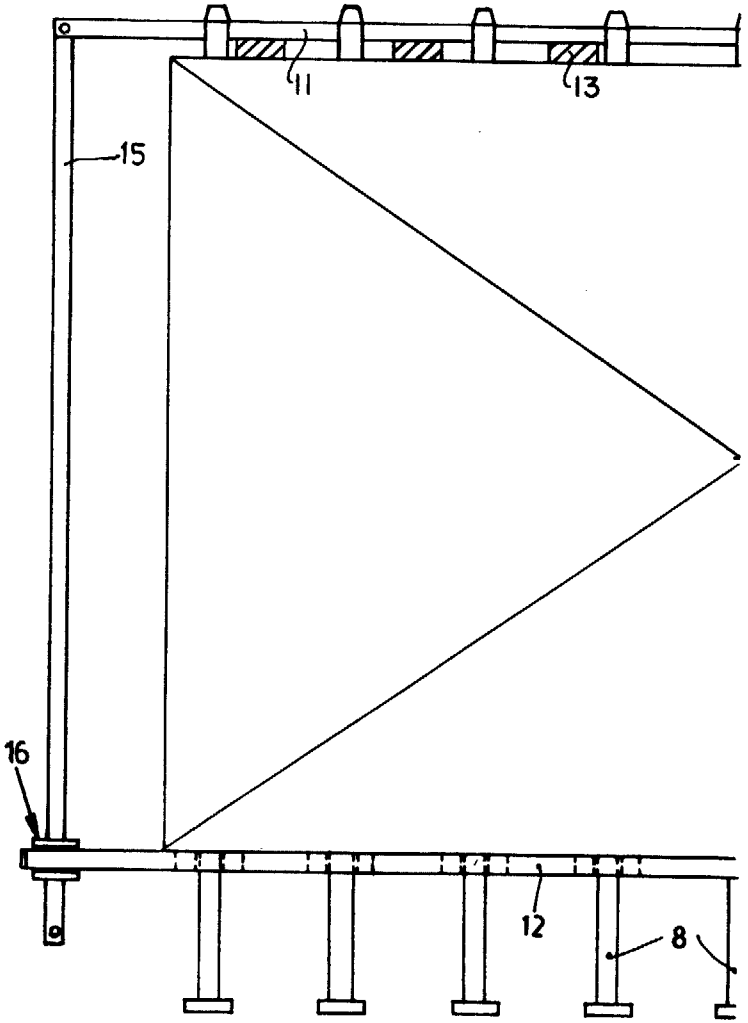
FIG. 2A is a top view of a portion of a first embodiment of the invention showing one position of the rear cross beam.

The carrier rods 8 are, as is best shown from FIGS. 2A and 2B, supported in the region of the stack front on a front cross rod 11 that is guided in a manner not shown in the drawing in the frame that supports the sheet-feeding device 1, and likewise are supported on a fear cross rod 12 in the neighborhood of the rear stack edge. According to the invention, the rear cross rod 12 is constituted as a movable part shiftable along the carrier rods 8 which can conveniently be brought up to the rear stack edge for every format of stack sheets to be processed. In changing over from a greater stack length, as represented in FIG. 2A, to a smaller stack length, as represented in FIG. 2B, the rear cross rod 12 can therefore be shifted so as to support the carrier rods 8 correspondingly further forward. In this manner, for every length of stack of sheets to be processed, support of the carrier rods 8 in the region of the rear stack edge, and consequently an advantageous shortening of the bending length of the carrier rods 8, can be provided. The sagging of the carrier rods, accordingly, remains correspondingly small. Furthermore, a practically symmetrical sag profile relative to the stack middle results, so that the falling over of the stack to one side or the other is practically out of the question and a spontaneous rearward shift of the stack is effectively guarded against. The front stack edge, accordingly, is prevented from shifting away from the front stack stops shown at 13 in FIG. 2A and 2B.

The rear cross rod 12, which can be made very heavy in order to obtain high stability of shape, is mounted with its ends respectively on two lateral rods 14 and 15 running essentially parallel with the carrier rods 8. In the illustrated example, these lateral rods 14 and 15 are detachably connected at their front ends to the front cross rod 11. In the region of their rear end the lateral rods 14 and 15, if desired, can be guided by rollers or the like on the sides of the frame pillars of the sheet-feeding device 1. In the illustrated example the lateral rods 14 and 15, like the carrier rails 5 of the main hoist, are free of such guiding means. Under certain circumstances, it could be desired to combine the front cross rod and the lateral rods 14 and 15 as a single frame unit. The illustrated embodiment has its lateral rods 14 and 15 merely detachably connected with the front cross rod 11, as for example by suspension fastenings. By unhooking the lateral rods 14 and 15 it is possible to provide free lateral access to the inside of the apparatus. In some circumstances it may be sufficient to connect the lateral rods 14 and 15 pivotably on the front cross rod 11. For receiving the ends of the rear cross rods 12, a shiftably guided holder 16 is provided on each of the lateral rods 14 and 15 that has a forked-shaped head 17 with a seating groove for accepting the rear cross rod 12. By this means a simple and nevertheless accurately producible and precisely adjustable arrangement is obtained. The lift falls 10 of the non-stop hoist hook on approximately in the region of the corners of the frame formed by the front cross bar 11 and the two lateral rods 14 and 15. The front hoist falls can be connected with the front cross rod 11 or directly with the lateral rods 14 and 15, respectively. In order to make possible an exact horizontal leveling, screw threaded positioning devices not shown in the illustrated embodiment can be interposed between the rods and the hoist.

Figure 3:
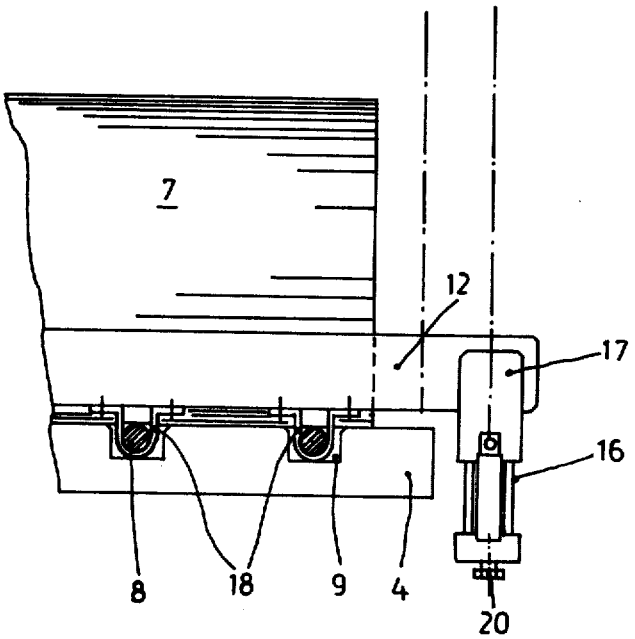
FIG. 3 is a partial rear view of the device of FIG. 2 along the section line III—III of FIG. 2.

The carrier rods 8 can lie with their front ends resting rather loosely on the front cross rod 11. In the region of the rear cross rod 12, a suspension arrangement is provided. That makes possible for the rear cross rod 12 to be located essentially above the carrier rods 8, so that even an excessive length of the stacking table 4 into which the carrier rods 8 fit does not interfere with the adjustability of the rear cross rod 12 along the length of the carrier rods 8 that is a major feature of the present invention. As can be readily seen from FIG. 3, the rear cross rod 12 can for this purpose be provided at its lower edge with tubular collar holders 18 for the carrier rods 8. The holders 18 are of course spaced from each other at the same distance between centers as the grooves 9 of the stacking table 4 that likewise accommodate the carrier rods 8. Preferably, as shown in FIG. 3, the holders 18, as well as the carrier rods 8, can extend into the grooves 9 so that for any stack length, the rear cross rod 12 can without difficulty be moved right up against the rear edge of the stack 7. In this manner, the front surface 19 of the rear cross rod 12 itself advantageously forms a rear stop for the stack which prevents slipping of the stack portion that lies above the rods 8, particularly when the carrier rods 8 are withdrawn after a fresh stack has been made ready beneath the residue of the previous stack.

In many cases it can also useful to provide carrier rod holders in the form of tumbling hooks that automatically latch in place and can be brought into position from above. In such case it could be helpful to provide a separate and preferably adjustable stop board for the rear stop for the stack.

In the illustrated example, the carrier rods 8 rest on the front cross rods 11 without any holding connection, a feature that eliminates unnecessary additional expense. It would of course be possible at justifiable expense to provide corresponding carrier rod holders at the location of the front cross rod 11 if that should be desired in a particular case, perhaps for providing an easy removal of the front cross rod. For this purpose the front cross rod 11 could in some simple way be provided in its lower portion with corresponding bores for insertion of the carrier rods 8. Along this line, the stacking table 4 could be provided with a corresponding cross groove into which the cross rod 11 could dip. In cases of this sort a construction could be used in which each of the lateral arms 14 and 15 is provided with two cross rod holders, which can be engaged quickly either from above or, as illustrated, from below with the corresponding cross rods.

In order to maintain for long periods of operation the integrity of an adjustment of the holders 16 that has once been determined, the holders 16 that are slidably mounted on the lateral rods 14 and 15, respectively, are provided with clamping devices. As FIG. 3 shows, a clamping screw 20 can be used for this purpose. In some cases the time required for making the necessary adjustments can be reduced if appropriate scale markings are provided on the lateral rods 14 and 15.

Figure 4:
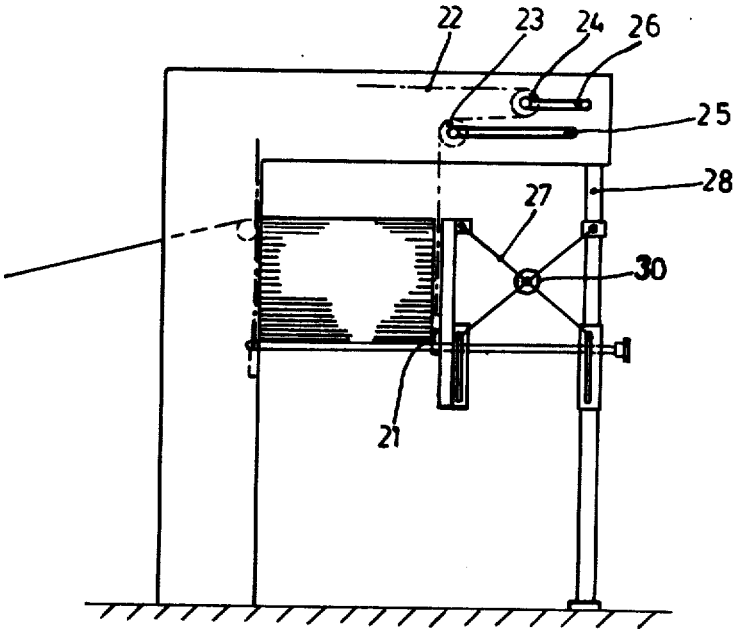
FIG. 4 is a diagrammatic side elevation view of a different embodiment of the invention.

As shown in FIG. 4, it is also possible to provide the adjustment of the position of the rear cross rod so that, according to the invention, it abuts the rear edge of the stack, by means of a corresponding shift of the horizontal position of the pulleys from which the lifting chains of the hoist connections to the rear cross rod are suspended, instead of adjusting the position of the rear cross rod on lateral rods equipped with sliding holders that can be clamped in position, as shown in FIG. 2. In the embodiment shown in FIG. 4, the lifting chain 22 at each end of the rear cross rod 21 is guided over two pulleys 23 and 24, each of which have their axles horizontally shiftable along guides symbolically shown at 25 and 26. Each pulley 23 is set so as to put the rear cross rod 21, which is suspended directly below it, alongside the rear stack edge. The associated pulley 24 is set so that its axle is shifted by only half the amount of shift from the rearmost position that is provided for the pulley 23, so that the shifting of the two pulleys in this proportion will move the suspension of the rear cross rod 21 horizontally without changing the level at which the rear cross rod is suspended, assuming of course that the hoist which operates the chains 22 remains stopped in the same position. In order to make possible a precise and rapid adjustability of the two pulleys 23 and 24 of each hoist chain 22, their axles can be positioned in the direction of sheet-feeding by means of a positioning lever device having an arm of one length for actuating the movement of the axle of the pulleys 24 and an arm of twice that length for shifting the axle of the pulleys 23. These levers can be swung together into a desired adjustment position by turning a shaft on which they are mounted. Other ways of providing coordinated movement for the pulleys 23 and 24 can be devised, as will readily be understood, and for this reason no particular method or device for so doing is illustrated in FIG. 4.

With a suspension adjustment for the rear cross rod 21 as just described, it is desirable to prevent the cross rod 21 from swinging back on its suspension in order that it may, according to the invention, operate as a rear stop for the sheet material stack, as well as a support for the carrier rods 8. The necessary rearward support is shown in FIG. 4 in the form of adjustable scissors braces 27 mounted and guided on the rear frame supports 28 of the sheet-feeding mechanism. Such scissors braces 27 are provided at both ends of the rear support rod 21. While the position of the rear cross rod 21 is being adjusted to the particular rear stack edge, the scissors braces 27 swing apart or together as required. When the rear cross rod 21 has been placed in its desired position, the angular position of the scissors braces can be fixed to provide the necessary rearward support, for example by tightening a clamp 30 at the intersection of the two members of each set of scissors braces 27. In this manner the rear cross rod 21 can evidently be supported over its entire effective length against rearward deviation from position.

Although the invention has been described with reference to a few illustrative preferred embodiments, it is evident that modifications and variations are possible within the inventive concept. The embodiments of the invention specifically illustrated in considerable detail are particularly suitable for incorporation in sheet-feeding devices for feeding paper sheets to a printing press, but as the invention is applicable to other systems for feeding sheets varying more or less in stiffness, thickness, etc., it may be expected that the design of carrier rods, cross rods, and adjusting devices may need to be varied in detail to suit the particular application.

We claim:

1. In a continuously operable sheet-feeding mechanism for a printing press or other discrete sheet processing machine, a device for replenishing a stack of sheets in position for sheet-feeding, without interruption of the progress of sheet-feeding, comprising, in combination:

a stacking table;

a frame for supporting sheet-feeding apparatus above the stacking table;

first hoist means for lifting and lowering the stacking table within said frame;

a set of parallel carrier rods oriented parallel to the direction in which sheets are fed off said stack by the sheet-feeding apparatus supported by said frame, which carrier rods are insertable below the bottom of a stack of sheet material into a set of parallel grooves distributed over the area of the stacking table;

a front cross rod and a rear cross rod perpendicular to the carrier rods, arranged so as to support said carrier rods and extending completely across the set of carrier rods, and second hoist means for lifting and lowering said cross rods, whereby said carrier rods and a depleted stack thereon may be lifted gradually on said carrier rods as required by said sheet-feeding apparatus while the stacking table is lowered to receive a new stack of sheet material, said rear cross rod being adjustable in the sheet-feeding direction so that it may abut the rear edge of a stack of sheet material on said stacking table and having a configuration and disposition such as to function as a rear stop for the bottom of a stack that is located above the carrier rods, said carrier rods being insertable in support means affixed to said cross rods at the time they are inserted in said grooves of said table and being withdrawable after a new stack is brought up under them by said first hoist means.

2. A device as defined in claim 1 in which the rear cross rod (12. 21) is provided at its underside with means (18) for supporting the carrier rods (8).

3. A device as defined in claim 2, in which said means for supporting the carrier rods are in the form of suspension collars encircling the carrier rods.

4. A device as defined in claim 3, in which said second hoist means includes hoisting lines (22) connected to said rear cross rod (21) that are provided with pulleys (23) the horizontal position of which is adjustable in accordance with the stack dimension in the direction of sheet-feeding.

5. A device as defined in claim 4, in which for each of said pulleys (23) that is adjustable in accordance with the stack dimension, there is provided a second pulley (24) that is adjustable in the direction of sheet-feeding, but always for half of the distance from a reference position through which the pulley adjustable in accordance with the stack dimension is displaced.

6. A device as defined in claim 5, in which the rear cross rod is supported rearwardly against said frame by scissors braces (27) that are provided with means (30) for fixing their adjustable positions.

7. A device as defined in claim 1, in which the rear cross rod (12) is set adjustably, according to the stack dimension, on two lateral rods (14,15).

8. A device as defined in claim 7, in which both of said lateral rods (14, 15) are connected at their front ends with the front cross rod (11) and are each connected to a lifting member of said second hoist means at their respective rear ends.

9. A device as defined in claim 7, in which said lateral rods (14, 15) are removable.

10. A device as defined in claim 9, in which a holder (16) for the rear cross rod (12) is slidably mounted on each of said lateral rods (14, 15).

11. A device as defined in claim 10, in which each of the holders (16) provided on the lateral rods (14, 15) has a forked upper part between the tines of which said rear cross rod (12) can be seated.

12. A device as defined in claim 11, in which each of the holders (16) of the lateral rods (14, 15) can be positioned on the corresponding lateral rod by clamping means (20).

* * * * *